US006780941B2

(12) United States Patent
Studholme et al.

(10) Patent No.: US 6,780,941 B2
(45) Date of Patent: Aug. 24, 2004

(54) PROCESS FOR PREPARING POLYMERIC FIBERS BASED ON BLENDS OF AT LEAST TWO POLYMERS

(75) Inventors: Matthew B. Studholme, Abingdon, VA (US); Arthur Roth, Jr., Bristol, VA (US); Brendan Francis McSheehy, Jr., Abingdon, VA (US)

(73) Assignee: Prisma Fibers, Inc., Bristol, VA (US)

( * ) Notice: Subject to any disclaimer, the term of this patent is extended or adjusted under 35 U.S.C. 154(b) by 10 days.

(21) Appl. No.: 09/849,240

(22) Filed: May 7, 2001

(65) Prior Publication Data

US 2002/0123576 A1 Sep. 5, 2002

Related U.S. Application Data

(60) Provisional application No. 60/257,092, filed on Dec. 22, 2000.

(51) Int. Cl.[7] ..... C08G 63/91; C08L 77/00

(52) U.S. Cl. ..... 525/419; 525/420; 525/425; 525/437; 525/451; 524/538; 524/539; 524/602

(58) Field of Search ..... 525/419, 420, 525/425, 437, 451; 524/538–539, 602, 99; 428/475.2, 357, 364, 395

(56) References Cited

U.S. PATENT DOCUMENTS

| | | | | |
|---|---|---|---|---|
| 3,369,057 | A | | 2/1968 | Twilley |
| 3,378,056 | A | | 4/1968 | Robertson |
| 3,470,686 | A | | 10/1969 | Fleming et al. |
| 3,549,741 | A | | 12/1970 | Caison et al. |
| 4,150,674 | A | | 4/1979 | Yung |
| 4,374,641 | A | | 2/1983 | Burlone |
| 4,417,031 | A | | 11/1983 | Aharoni et al. |
| 4,479,718 | A | | 10/1984 | Alman |
| 4,963,311 | A | | 10/1990 | Aharoni et al. |
| 5,055,509 | A | | 10/1991 | Bjattacjarkee et al. |
| 5,270,401 | A | | 12/1993 | Sham et al. |
| 5,300,572 | A | | 4/1994 | Tajima et al. |
| 5,587,118 | A | | 12/1996 | Mallonee |
| 5,597,650 | A | | 1/1997 | Mallonee |
| 5,620,797 | A | | 4/1997 | Mallonee |
| 5,674,948 | A | | 10/1997 | Vonk |
| 5,811,040 | A | | 9/1998 | Mallonee |
| 5,834,089 | A | * | 11/1998 | Jones et al. ..... 428/97 |
| 5,889,089 | A | * | 3/1999 | Caswell et al. ..... 523/205 |
| 6,090,494 | A | | 7/2000 | Rao |
| 6,495,079 | B1 | * | 12/2002 | Gallucci et al. ..... 264/78 |
| 2002/0173591 | A1 | * | 11/2002 | Chisholm et al. ..... 525/183 |
| 2003/0129398 | A1 | * | 7/2003 | Gallucci et al. ..... 428/375 |
| 2003/0146536 | A1 | * | 8/2003 | Sunderland et al. ... 264/172.17 |

* cited by examiner

*Primary Examiner*—P. Hampton Hightower
(74) *Attorney, Agent, or Firm*—Miles & Stockbridge P.C.; John C. Kerins

(57) ABSTRACT

Blending of thermoplastic polyester with fiber-forming polyamide in the production of melt-colored melt-spun fibers results in improved color strength and aesthetics, and dimensional stability.

13 Claims, 1 Drawing Sheet

PROCESS FOR PREPARING POLYMERIC FIBERS BASED ON BLENDS OF AT LEAST TWO POLYMERS

CROSS-REFERENCE TO RELATED APPLICATION

This application contains subject matter disclosed in U.S. Provisional Patent Application Serial No. 60/257,092 filed Dec. 22, 2000, and this application claims the benefit of the filing date of said U.S. provisional application.

BACKGROUND OF THE INVENTION

1. Field of the Invention

The invention is generally aimed at a process for the preparation of melt spun, melt-colored, fibers. In particular, the invention relates to a process to form melt-colored fibers, from blends of at least one fiber-forming polyamide with at least one polyester, that exhibit improved color and aesthetics in comparison with equivalent melt-colored fibers manufactured using polyamide alone. In addition, the melt-colored fibers also exhibit improved dimensional stability when the fibers are exposed to changes in temperature and/or humidity.

2. Description of Related Art

Coloration of fibers has a long history, and the science of dyeing, initially of natural fibers such as flax, cotton and wool, has been under continuous development since Neolithic times. The appearance of man-made fibers, (e.g., cellulosics, acrylics, polyamides and polyesters), stimulated further developments in dyeing, and this method of coloring of fibers and articles made therefrom continues to be the most-practised technique for the production of colored fiber-based articles of manufacture.

In the case of fibers based on the more recent polymers such as polyamides and polyesters, which are spun from the melt, there exists an alternative method for coloration, i.e., addition of the colorant species into the melt and direct extrusion of colored fibers. While such a process may be carried out with dyes, it is more often carried out with pigments. Notwithstanding this fact, the process is popularly known throughout the industry as "solution dyeing". The major difference between dyes and pigments is that, under prevailing processing conditions, pigments are virtually insoluble in polymers, whereas dyes are soluble, (see definitions in German Standards DIN 55943, 55944 and 55949, incorporated herein by reference).

As the technique of melt-pigmentation has been developed, it has been demonstrated that fibers made in this way can exhibit certain advantages over those made by post-spinning dyeing of fibers. Such advantages include improved resistance to degradation and fading in sunlight; lower susceptibility to fading and/or yellowing by polluting gases in the atmosphere, such as ozone and nitrogen oxides; improved resistance to chemicals, either in dry-cleaning processes or encountered in accidental spillages; less leaching or fading of color during laundering or cleaning processes involving water and detergents; no need for post-spinning industrial processes to color the products or to fix the color in place.

However, melt-pigmentation is also considered to have some disadvantages in terms of the color and appearance obtained in the final fiber. The fibers are generally regarded by those skilled in the art to exhibit degrees of lustre and low brightness that can render the said fibers unsuitable in certain applications.

The color change resulting from the addition of pigments to polymers is based on the wavelength-dependent absorption and scattering of light, with the appearance and color of the final product being a combination of these two factors as described in the Kubelka-Munk theory. A description of this theory, along with the general concepts of color and its measurement, may be found in "Colour Physics for Industry", Roderick McDonald, (Ed.), The Society of Dyers and Colourists, Bradford, UK, $2^{nd}$ Edition, (1997). Dyes can only absorb light and not scatter it, since the physical prerequisite for scattering—a certain minimum particle size—does not exist in the case of dyes in molecular solution; these colors are therefor transparent. Insofar as the transparency may be said to be attributable to the dye, complete absorption of light will result in black shades, selected absorption will result in colored shades.

The optical effect of pigments may in the same way be based on light absorption. If, however, the refractive index of the pigment differs appreciably from that of the polymer which is almost invariably the case, and if a specific particle size range is present, scattering takes place. Under these conditions, the initially transparent polymer becomes white and opaque, or, if selective absorption takes place at the same time, colored and opaque.

No scattering occurs when the particle sizes are very small, and none or very little occurs if they are very large. With all colored pigments that selectively absorb, the shade and strength of the final color is thus influenced by particle size. The transparency and thickness of the colored substrate may additionally affect the color strength. While some pigments are available in so-called transparent grades, e.g., red and yellow iron oxides, a complete color range across the spectrum is not readily available. Many such ultra-low particle size colorants are expensive, and difficult to maintain at high dispersion when compounded into a polymer matrix. It is also known that very low particle size additives in polymer melts can produce a profound effect on the Theological properties of said melt, resulting in formulations which are difficult to spin using standard equipment and procedures. Use of large particle size colorants is not a viable option either, as such additives will result in the blocking of spinneret orifices, pressure problems with filtration systems, and will lead to unacceptable levels of filament breaks in fiber production.

In any case, a large number of melt-pigmented fiber products are required to be opaque, and the problem lies in producing colored fibers with levels of color brightness close to those of dyed products. Note that a fundamental difference between dyeing and pigmenting of fibers is that, while dyes, or their mixtures, are either colored or absorb all wavelengths of light, (i.e., give black shades), pigmentation introduces an extra variable in that white pigments are readily available, whereas there is no such species as a "white dye", nor can any combination of dyes result in a white fiber.

Another problem with particulate colorants in a polymeric melt-spun fiber is the phenomenon of dichroism, or optical anisotropy. Pigment particles are not necessarily isotropic in shape, and indeed may be needle-shaped, rod-shaped, or platelets. They may thus become oriented in a preferred direction due to the forces they encounter during processing of the melt and of the fiber. The apparent color then depends on the direction of observation. The origin of this phenomenon is to be found in the fact that certain pigments crystallise in crystal systems of low symmetry, resulting in directionally dependant physical properties. As far as the coloristic properties are concerned, this means that the absorption and scattering constants differ in the various principal crystallographic axes, i.e. such crystals are optically anisotropic.

With regard to the final fiber, as opposed to the above comments on the pigments themselves, the appearance of a sample thereof can vary depending on the angle of illumination and/or observation. Fiber samples are normally prepared for color and appearance testing by carefully wrapping the fiber or yarn sample, under conditions of uniform tension and consistent positioning of the said fibers, around a flat "card", and assessing the color properties, and, more importantly, any differences between said properties and those of the desired sample or data, under standard conditions of illumination and observation. This may be carried out visually, but more usually is carried out using instrumentation. Methods and apparatus for carrying out the analysis of color and appearance in this manner are well known to those skilled in the art, and are not discussed in detail herein.

During such examinations, there are two additional effects that might be observed if the sample is illuminated or observed at a number of different angles. An example of multi-angle appearance testing of materials is reported in U.S. Pat. No. 4,479,718, assigned to DuPont. The first possible effect is that the total amount of light reflected from the sample, per unit area, may change. The second possible effect is that the ratio of the various reflected and scattered wavelengths may change, resulting a change in the measured or perceived color. Unless such effects are specifically desired for particular aesthetic reasons in a final article of manufacture, the appearance of either may result in rejection of the fiber by the prospective customer. Eradication or reduction of such effects is thus important in obtaining first quality product.

The basic concept of blending of at least two polymers in a melt in order to manufacture articles is well known in the art, and this technique has been applied in a number of cases for the manufacture of fibers. In the majority of cases, polymer pairs are incompatible, i.e., the minor component of the blend forms a dispersed, discrete, phase within a matrix of the major component.

Where the incompatibility between the polymers is pronounced, the physical properties of the blend are liable to be poor, there being little or no adhesion between the matrix and the dispersed phase. A widely practised remedy to this problem is the use of so-called compatibiser additives. Such additives may function in a variety of ways, including acting as surfactants to reduce the surface tension between the two phases of the blend, chemically reacting with both phases to "tie" them together, or physically interacting with both phases to bind them together. Particular compatibilisers may function in more than one way. The use of such additives in polymer blends is well known to those skilled in the art. A detailed discussion of this aspect of polymer technology may be found in "Compatibilising agents—Structure and function in polyblends" by N. G. Gaylord—Journal of Macromolecular Science Chemistry, A26, 1211–1229 (1989).

Fibers produced by melt-blending using polyamide as major component and polyester as minor component are known in the art, and have been manufactured with a variety of purposes in mind.

One area in which this method has been successfully applied is in the field of reinforcing yarns for pneumatic tires, ("tire-cord"). Examples of such prior art include U.S. Pat. Nos. 3,369,057 and 3,470,686, assigned to Allied Chemical Corporation. In those patents, fibers are spun which comprise a dispersed phase of polyester, such as poly(ethylene terephthalate) in polyamide, such as polyamide 6. The use of such materials in a tire-cord is claimed to provide tires with less susceptibility to "flat-spotting" than have tires reinforced with cords made from polyamide alone.

In U.S. Pat. No. 3,549,741, assigned to Allied Chemical Corporation, there is the disclosure of the production of carpet fiber from melt blends of polyamide and polyester, but the invention states quite clearly that such blends are require to be processed using non-standard equipment, and under different conditions to those normally used to manufacture carpet fibers from polyamide alone.

In U.S. Pat. No. 6,090,494, issued to DuPont, and in corresponding PCT application WO99/46436, it is asserted that "shaped articles", including fibers and yarns, may be produced by melt-blending polyamide with one or more pigments in a suitable carrier, and also with 0.5 to 9 weight % of a polyester. It is stated in the patent that the claimed fibers may be spun under standard polyamide processing conditions. While it is noted that the practise of this invention allows inclusion in the blend of certain pigments which cause physical property deterioration in the final fiber if used in polyamide alone, it is nowhere disclosed that any enhancement of color brightness or fiber aesthetics will result from the practise of the invention.

Compatibilised blends of polyamide and polyester have also been disclosed for use in the melt-spinning of fibers. Examples include:

U.S. Pat. No. 3,378,056, (Firestone Tire & Rubber Co.), describes the manufacture of tire-cord using a blend of polyester and polyamide compatibilised by the addition of poly(hexamethylene isophthalate).

U.S. Pat. No. 4,150,674, (Monsanto), discloses the use of a lactam-polyol-polyol-polyacyllactam terpolymer as compatibilising agent in blends of polyamide and polyester for use in the manufacture of non-woven fabrics.

U.S. Pat. No. 4,417,031, (Allied Corporation), is concerned with the use of reactive phosphite species, e.g., tributyl or triphenyl phosphite, as compatibilisation agents in blends of polyamide and polyester for use in the manufacture of tire-cord.

U.S. Pat. No. 4,963,311, (Allied-Signal), describes a process similar to that in U.S. Pat. No. 4,417,031 discussed above, in which a polyester reacted with phosphite is itself used as a compatibiliser in a blend of polyamide and unreacted polyester. Also aimed at production of improved tire-cord.

U.S. Pat. No. 5,055,509, (Allied-Signal), claims the use of phosphoryl azides as reactive compatibilisers in polyamide/polyester blends. Once again, this patent is aimed at the manufacture of improved tire-cord.

U.S. Pat. No. 5,270,401, (DSM NV), describes a melt-spinnable blend consisting of polyamide and polyester, where the two phases are enhanced in compatability by adding both a copolyester which contains up to 50 mol % of an aliphatic dimer fatty acid, and an amine or acid grafted polymer.

None of these patents directed to compatibilised blends of polyamide and polyester note any changes to, or enhancements of, color or appearance of the fibers made therefrom.

A need thus continues to exist in the industry for a simple method to provide pigmented articles, especially melt-spun fibers, with improved color and appearance, whilst still using standard grades of pigment currently known to those skilled in the art to be suitable for this purpose, and equipment and techniques known to produce melt-pigmented fibers of the required properties for use in manufactured articles such as fabrics, textiles, carpets, threads etc.

One attempt which has been made to achieve this end is described in U.S. Pat. No. 5,674,948, assigned to DSM NV. This patent claims that end-capping of the amino end-groups of polyamides results in improvements to the brightness of compositions colored with organic pigments which are capable of themselves reacting with such amino end-groups. N-acetyl lactam is noted as a particularly preferred end-capper. This approach does not, however, fully solve the problem as the effect is limited to a particular set of organic pigments. The levels of additive end-capper required to achieve a sufficient reduction in the level of free amine end-groups to produce a noticeable effect are also quite high. Finally, the use of this approach requires a prior knowledge of the amine end-group level in the polyamide (a non-trivial analytical task), and requires that the additive end-capper level be varied from polyamide to polyamide, or even from batch to batch of the same polyamide, to account for differing levels of amine end-groups therein.

When objects made from polyamides, such as fibers, yarns, and products produced from fibers and yarns such as fabrics, carpets and other floorcoverings are subjected to different temperature and humidity environments, changes in the physical dimensions of such objects can occur, including but not limited to, shrinkage, warping, distortion, bowing or curling of the object. These changes in physical dimensions can be objectionable for certain applications of the fibers and yarns.

The present inventors have discovered the surprising fact that melt-pigmented blends of one or more fiber-forming polyamides and one or more thermoplastic polyesters, where the thermoplastic polyester is the minor phase, and which optionally contain suitable compatibilising additives for the two polymer types, may be melt-spun into fibers which exhibit improved color and appearance over similarly colored fibers based on the fiber-forming polyamide alone. The improvement in appearance between two samples can be measured as color strength. In addition, the fibers also have improved dimensional stability.

DETAILED DESCRIPTION OF THE PREFERRED EMBODIMENTS

Figure 1:
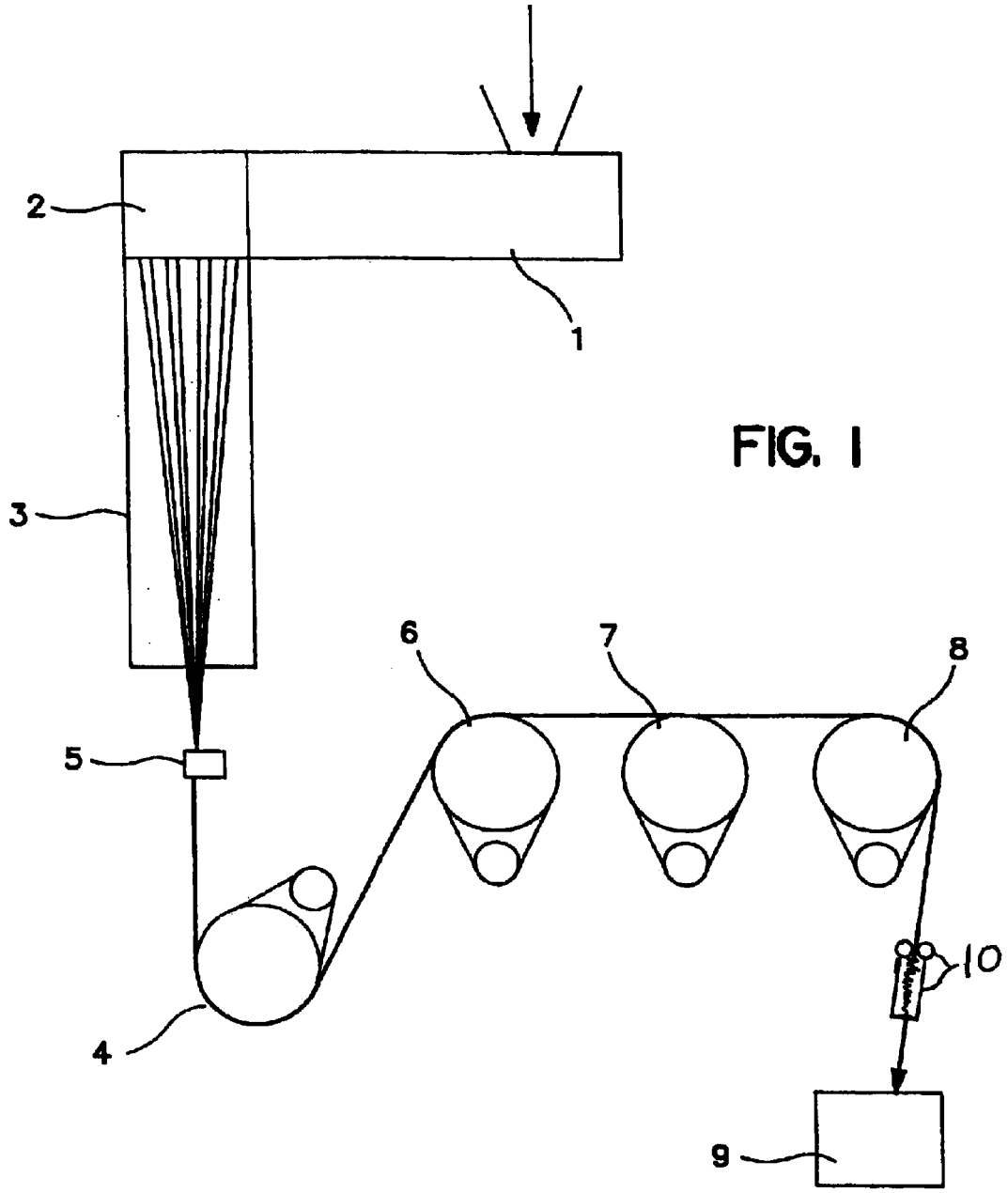
FIG. 1 shows, in substantially schematic form, a melt spinning, melt pigmentation apparatus for producing fibers.

Referring to FIG. 1, conventional melt spinning equipment is preferably used in carrying out the process of the present invention. The melt blending of at least one fiber-forming polyamide, at least one thermoplastic polyester, the colorant system, and optionally any polymeric compatibiliser and other additives, involves introducing these starting materials into an extrusion device 1, where the materials are heated and mixed, and pumped through a spinneret 2. The continuous filaments emerging from the spinneret are passed through a quench chamber 3 and a spin finish applicator 5 to an unheated feed godet roll 4. The undrawn yarn may be wound by winding device 9 without any further processing, such as draw-texturing, which could then be done later as a separate process. Alternatively, the filaments may be passed from roll 4 to a further set of draw godet rolls 6 and 7, and optionally 8, of which at least rolls 6 and 7 are heated. The speed of rolls 6, 7 and 8 are controlled such that the filaments are drawn between the rolls. The fibers may optionally be textured, as by mechanical crimper 10 or other known texturing process, such as air-jet texturing, prior to being wound by winding device 9. As noted elsewhere herein, various other conventional process steps may be employed in addition to, or instead of, the steps shown herein. Various of the starting materials may also be added at different points prior to being pumped to, or at, the spinneret 2.

The polyamide forming the major phase of the blend used in the inventive process may be selected from those synthesised from monomeric components such as lactams, alpha-omega amino acids, and pairs of diacids and diamines. Such polyamides include, but are not limited to polycaprolactam [polyamide 6], polyundecalactam [polyamide 11], polylauryllactam [polyamide 12], poly(hexamethylene adipamide) [polyamide 6,6], poly(hexamethylene sebacamide) [polyamide 6,10], poly(hexamethylene dodecanediamide) [polyamide 6,12], and copolymers and blends thereof. Preferred polyamides are polyamide 6 and polyamide 6,6. The polyamide used may be virgin polymer, or may be wholly or partially reclaimed materials.

The thermoplastic polyester used as the minor phase of the blend used in the inventive process to melt-spin melt-pigmented fibers may be selected from those synthesised from monomeric components such as one or more diacids and one or more glycols, or synthesised from hydroxyacids. Such polyesters include, but are not limited to, poly(ethylene terephthalate) [PET], poly(propylene terephthalate) [PPT], poly(butylene terephthalate) [PBT], poly(ethylene naphthalate) [PEN], poly(propylene naphthalate) [PPN], poly(butylene naphthalate) [PBN], poly(cyclohexane dimethanol terephthalate) [PCT], poly(ethylene succinate) [PES], poly(butylene succinate) [PBS], poly(ethylene adipate) [PEA], poly(butylene adipate) [PBA], poly(lactic acid) [PLA], poly(3-hydroxybutyrate) [PHB], and copolymers and blends thereof. Preferred polyesters are PET, PPT and PBT. As was noted above for the polyamide component of the blend utilised in the inventive process, the polyester component of the said blend may also consist of virgin polymer, or may comprise wholly or partially of reclaimed materials.

The polymeric compatibiliser which may optionally be present in the blend utilised in the inventive process is preferably a sulphonated polyester or metal sulphonated polyester, most preferably alkali metal, or ammonium, salts of poly(ethylene terephthalate-co-sulphoisophthalate) [SPET], or poly(butylene terephthalate-co-sulphoisophthalate) [SPBT]. The compatibiliser may be added directly to the screw extruder, or may alternatively be used as all or part of the carrier of a color concentrate and thus added when the color concentrate is introduced. Further, it may be desirable to add the compatibiliser partly into the screw extruder directly, and partly in the addition of the color concentrate or concentrates.

Colorants used in the practise of this invention may be selected from the categories of dyes, inorganic or organic pigments, or mixtures of these. Any number of different colorants may be used, in any proportions, although it will be understood by those skilled in the art that the total loading of colorants in the blend matrix, and the number of different colorants used, will be kept to a minimum commensurate with obtaining the color required in the final fiber. Generally the level of colorants will range form 0.1 to 8.0 weight % of the fiber.

Inorganic pigments include, but are not limited to, metal oxides, mixed metal oxides, sulphides, aluminates, sodium sulphosilicates, sulphates and chromates. Non-limiting examples of these include carbon blacks, zinc oxide, titanium dioxides, zinc sulphides, zinc ferrites, iron oxides, ultramarine blue, Pigment Brown 24, Pigment Red 101, and Pigment Yellow 119.

Organic pigments include, but are not limited to, azos, disazos, quinacridones, perylenes, naphthalene tetracarboxylic acids, flavanthrones, isoindolinones, tetrachloroisoindolinones, anthraquinones, anthanthrones, dioxazines, phthalocyanines, and azo lakes. Non-limiting examples of these include Pigment Blue 60, Pigment Red 122, Pigment Red 149, Pigment Red 177, Pigment Red 179, Pigment Red 202, Pigment Violet 29, Pigment Blue 15, Pigment Green 7, Pigment Green 36 and Pigment Yellow 150.

It will be understood by those of ordinary skill in the art that the aforenoted pigment designators, such as Pigment Brown 24, are made up of a classification name and a serial number, and these are known as Colour Index Generic Names. These designators are published in "The Colour Index", a publication of The Society of Dyers and Colourants, England.

Colorants may be added to the polymer blend in a variety of ways depending on the nature of the colorant. These include direct addition of colorants to the matrix polymers, addition of single colorant dispersions, i.e., addition of each colorant as a separate color concentrate in a carrier resin, and addition of multiple colorant dispersions, i.e., addition of a single color concentrate of mixed colorants, providing the desired color on let-down into the matrix polymers. Any of these addition methods may be carried out as a separate compounding step prior to melt-spinning, or may be carried out on the melt-spinning apparatus itself. In either case, the colorants or colorant dispersions may be added at any stage of the process, for example at the extruder throat, at any addition port on the extruder barrel, at the melt pump, or at the spinneret. More than one addition point may be utilised.

For colorant dispersions, the carrier resin used may be preferably selected from a set consisting of low or high molecular weight polymers that have a suitable compatibility with one or both components of the blend of polyamide and polyester. One skilled in the art of polymer compounding and blending will be familiar with which carrier polymers should provide suitable vehicles for the colorants. Preferred carrier resins are PET, PBP, PPT, sulphonated polyesters, polyamide 6, polyamide 11, polyamide 12, polyamide 6,6, polyamide 6,10, polyamide 6,12, and copolymers and blends thereof. Note that, if desired, the polyester used as the minor component of the blend may act as carrier for some or all colorants used; the same can be true of the compatibiliser, if such is included in the blend.

Besides the components described above (polyamides, polyesters, compatibilisers and colorants), the blend may include adjuvants. These adjuvants include, but are not limited to, antioxidants, UV stabilisers, antiozonants, soil-proofing agents, stainproofing agents, antistatic additives, antimicrobial agents, lubricants, melt viscosity adjusters, flame retardants and processing aids.

A formulation used in the practise of the present invention includes:

1) at least one fiber-forming polyamide, selected from the set of fiber-forming polyamides as this is defined above,
2) at least one thermoplastic polyester, selected from the set of thermoplastic polyesters as this is defined above, said thermoplastic polyester being present at a ratio of less than 2:1 with respect to the said fiber-forming polyamide and forming a dispersed, non-continuous, minor phase in a matrix of said fiber-forming polyamide,
3) a colorant system comprising one or more colorants selected from the sets of inorganic and/or organic colorants as these are defined above, said colorant system optionally including one or more carrier resins for said pigments, and optionally
4) at least one compatibilising species, as these are defined above.

In an especially preferred embodiment of the formulation used in the practice of the present invention, the said formulation consists of:

a) at least one fiber-forming polyamide,
b) at least one thermoplastic polyester, where the total amount of said thermoplastic polyester is between about 15 weight % and about 35 weight % of the formulation,
c) at least one colorant species, selected from organic or inorganic pigments, or combinations thereof, at a level between about 0.1 and about 8 weight % of the formulation, and optionally
d) at least one compatibilising species, selected from alkali metal or ammonium salts of poly(ethylene terephthalate-co-sulphoisophthalate) or poly(butylene terephthalate-co-sulphoisophthalate), at a level between about 1 and about 25 weight % of the formulation.

The level of sulphur in the especially preferred formulation is between 300 and 3500 ppm.

As stated previously, any or all of the above noted ingredients may be combined in a number of ways, either in separate melt-compounding steps prior to actual melt-spinning of the fibers, or during the fiber spinning process itself. Both separate compounding steps and melt-spinning may be carried out using techniques and equipment well known to those ordinarily skilled in the arts of polymer blending, polymer compounding and fiber melt-spinning. In particular, bulked continuous filament, (BCF), yarn, for use as face yarns for carpets and other floorcoverings, may be manufactured using the above formulations in the inventive process using equipment and conditions normally used to produce polyamide BCF yarns for the same purpose.

For the purposes of this specification, all steps performed prior to the actual melt-spinning of the fibers, generally performed at a spinneret, will be referred to collectively as being part of a "melt blending" stage of the process. Thus, melt blending would include, for example, screw extrusion of polymer pellets, addition of colorant systems, such as color concentrates, addition of compatibilisers, addition of adjuvants, and conveying polymer melt through any of static mixers, piping, and pumps, leading up to the spinneret where the polymer or melt blend is formed into filaments.

The fibers produced from the practise of the present invention may be a range of deniers per filament, (dpf), depending on the ultimate use to which such fibers may be put, in that a low dpf is generally for textile use, whereas a higher dpf would generally be for use in carpets. The cross-sectional shape of the fibers may also be any of a wide range of possible shapes, including, but not limited to, round, delta, trilobal, tetralobal, grooved or irregular. These product fibers may be subjected to any of the known downstream processes normally carried out on melt-spun fibers, such as drawing, crimping, bulking, twisting and heat setting. Such processes may be part of a continuous process from melt-spinning to final product, or may be carried out on reels of melt-spun fiber which have been manufactured and then stored for a period of time. The final yarns will be suitable for a number of applications, and for incorporation into a variety of articles of manufacture, such as apparel, threads, textiles, upholstery, wallcoverings, carpets and other floorcoverings.

The fullest improvement in color strength and appearance is achieved when the fibers made from the above described blends are drawn. The optimum draw ratio will vary with the exact nature of the fiber, especially the loading of the polyester component, colorant type and loading, and the presence or absence, and nature, of compatibiliser. This will also vary with the fiber diameter and cross-sectional shape. The draw ratio is defined as the ratio of the final length to the original length per unit weight of the yarn resulting from the drawing process. The optimum draw ratio for a given system can readily be determined by comparing the color strength of as-spun fiber with that of the same fiber drawn under different conditions. In general, a draw ratio of from about 1.05 to about 7.0 is preferred, with a draw ratio of from about 1.10 to about 6.0 being even more preferred. Fiber drawing may be achieved by any standard method known to one ordinarily skilled in the art of fiber downstream processing. The fiber may be drawn between two godet rolls, or pairs of rolls, or over a draw pin or pins, or a combination of the two. The drawing may be done in single or multiple stages. The fiber is usually heated to a temperature above the glass transition temperature of both the polyamide and polyester components prior to, or during, drawing to minimize fiber breakage, although heating is not a requirement of the process. The heating may be carried out via heating of the godet rolls, plates. Slits, pins or other means such as use of a heated chamber; hot gas such as steam, or hot liquid such as water, may also be used.

EXAMPLES OF THE INVENTION

The invention is illustrated by the following non-limiting examples.

Color Strength Measurements: The color strength is defined as the color yield or color intensity of a given sample in relation to a standard, (or another sample). A higher color strength means that a sample exhibits a more intense color compared to the standard. The higher the color strength the greater the difference in color intensity compared to the standard. When samples with the same type and amount of pigment(s) are compared, (as is the case in the following examples), a higher color strength means that the more intensely colored formulation can reach the same intensity as the standard with less pigment. This situation allows for more efficient use of the colorant.

Color strength was determined from the spectrophotometric data using the K/S summation method, where K/S is the Kubelka-Munk function, where K is the absorption coefficient and S is the scattering coefficient. The % color strength of a sample is defined as the ratio of the sum of K/S for the sample to the sum of K/S for the standard, (or other sample), expressed as a percentage. A percentage less than 100% indicates that the sample is less intense in color strength than the standard; a percentage greater than 100% indicates that the sample is more intense than the standard. Further details of Kubelka-Munk theory and the K/S summation method may be found in "Colour Physics for Industry", Roderick McDonald, (Ed.), The Society of Dyers and Colourists, Bradford, UK, $2^{nd}$ Edition, (1997).

Spectrophotometric measurements were made using an Optronik Multiflash M45 spectrophotometer and a commercial color evaluation software package. CIE illuminant $D_{65}$ was used. The color strength was read from a card wrap sample at measurement angles of 0/45 degrees.

Dimensional stability measurements: The two ends of a length of yarn of about 1 meter length are tied together to form a yarn loop. The yarn loop is conditioned for a period of at least 12 hours in a controlled temperature and humidity environment at 19–21° C. and 50–65% RH. A first weight (4 mg/denier) is then hung from the yarn loop for 30 seconds and the length of the loop determined, $C_b$. The first weight is removed from the loop. A second weight (200 mg/denier) is hung from the yarn loop for 30 seconds and the length of the loop determined, $L_b$. The second weight is removed and the yarn place in a water bath at a temperature of 95–100° C. for 5 minutes. The yarn is removed from the water and allowed to dry. The same weights are then hung from the yarn loop and the lengths measured in the same manner as described above, $C_a$ and $L_a$. The % crimp contraction before water exposure, CCBW, and the % crimp contraction after the water exposure, CCAW are calculated as follows:

$$CCBW=100(L_b-C_b)/L_b$$

$$CCAW=100(L_a-C_a)L_a$$

The difference in % crimp contraction before and after the water exposure is referred to as the dimensional stability. Smaller dimensional stability numbers indicate greater dimensional stability, i.e. less change in physical dimensions of the yarn.

The polyamide 6,6 and the polyamide 6 of all examples have relative viscosity in 96% sulphuric acid of 3.1 and 2.7 respectively. Both resins were dried to less than 1000 ppm moisture prior to use.

The PET has an intrinsic viscosity in dichloroacetic acid of 0.65 dl/g. The PET was dried to less than 50 ppm moisture prior to use. The same PET was used in all examples.

The PBT has an intrinsic viscosity in dichloroacetic acid of 0.80 dl/g. The PBT was dried to less than 500 ppm moisture prior to use.

The SPBT contains sufficient sulphur that, within the range of SPBT concentrations which may be introduced in the fiber, the fiber has between about 300 and about 3500 ppm sulphur. It has an intrinsic viscosity in 60/40 phenol/tetrachloroethane of 0.45 dl/g. It was dried to less than 1000 ppm moisture prior to use. The same SPBT was used in all examples.

Colorants used: PB15:1=pigment blue 15:1, PBr24=pigment brown 24, PBk6=pigment black 6, PBk7=pigment black 7, PW6=pigment white 6, PR202=pigment red 202, PY150=pigment yellow 150, YSPR101=yellow shade pigment red 101, PG7=pigment green 7, ZnO=zinc oxide, CuHal=copper halide.

All yarn denier values herein have the units g/9000 m.

Examples 1–10

Polyamide 6 (control), Polyamide 6,6 (control), polyamide 6/PET blends and polyamide 6/PET/SPBT blends, each with color concentrate, were melt blended on a single screw extruder, pelletized and dried to less than 1000 ppm moisture prior to fiber spinning. 20 weight % of PET was used in the polyamide 6/PET blends and the polyamide 6/PET/SPBT blends. 6 weight % SPBT was used in the polyamide 6/PET/SPBT blends. Brown and light blue melt pigmented colors in each polymer matrix were produced using the same color concentrates at the same addition levels. Polyamide 6 was used as the carrier for the color concentrate. The weight % of each colorant/adjuvant in fiber for the three colors are shown in Table 1.

TABLE 1

| Brown Yarns | Light Blue Yarns | Black Yarns |
|---|---|---|
| PB15:1 = 0.2186 | PB15:1 = 0.0318 | PBk7 = 0.5000 |
| PBr24 = 05673 | PR202 = 0.0451 | PW6 = 0.2602 |
| PBk7 = 0.0557 | PBk7 = 0.0975 | ZnO = 0.0500 |
| ZnO = 0.0500 | PW6 = 0.9600 | |
| CuHal = 0.03 | CuHal = 0.03 | |

The melt blended materials were extruded into undrawn fibers on a slow speed spinning line at a take up speed of 470 m/minute, through 30 hole, (trilobal shaped), spinneret to produce a 30 filament yarn bundle of 2500 denier, referred to as 2500/30Y yarn. The 2500/30Y yarn was then heated over a godet roll set at 170° C. and single stage drawn at a draw ratio of 3.6 to produce approx. 700/30Y denier drawn yarn. The yarns were precision wound onto cards on which spectrophotometric measurements were made. The color strength of polyamide 6/PET and polyamide 6/PET/SPBT blend yarns were compared to the polyamide 6 and polyamide 6,6 control yarns of the same color as shown in Table 2. In Table 2 it can be seen that the color strength of yarns made with polyamide 6/PET and polyamide 6/PET/SPBT polymer matices have greater color strength than either the polyamide 6 or polyamide 6,6 controls.

TABLE 2

| Example Number | Polymer Matrix | Color | % Color Strength Compared to Polyamide 6 Control | % Color Strength Compared to Polyamide 6, 6 Control |
|---|---|---|---|---|
| 1 | Polyamide 6/PET | Brown | 108 | 110 |
| 2 | Polyamide 6/PET/SPBT | Brown | 113 | 116 |
| 3 | Polyamide 6/PET | Blue | 112 | 116 |
| 4 | Polyamide 6/PET/SPBT | Blue | 116 | 121 |
| 5 | Polyamide 6/PET | Black | 105 | 105 |
| 6 | Polyamide 6/PET/SPBT | Black | 105 | 105 |

One yarn end of each of the brown, blue and black 2500/30Y yarns from the same polymer matrix were draw-textured and co-mingled together to produce 2400 denier, 90 filament, trilobal cross-section, (2400/90Y), BCF yarns. The yarns were drawn over a heated godet roll set at 170° C. single stage drawn at a draw ratio of 3.6 followed by mechanical crimping. The BCF yarns produced were tested for dimensional stability. The results are shown in Table 3. In Table 3, it can be seen that BCF yarns made with polyamide 6/PET and polyamide 6/PET/SPBT polymer matrices have greater dimensional stability than either the polyamide 6 or polyamide 6,6 controls.

TABLE 3

| Example Number | Polymer Matrix | Dimensional Stability |
|---|---|---|
| 7 | Polyamide 6 (control) | 24 |
| 8 | Polyamide 6, 6 (control) | 27 |
| 9 | Polyamide 6/PET | 14 |

TABLE 3-continued

| Example Number | Polymer Matrix | Dimensional Stability |
|---|---|---|
| 10 | Polyamide 6/PET/SPBT | 8 |

Examples 11–23

Polyamide 6,6 (control), and polyamide 6/PET/SPBT blends with 0, 3, 4.5, 6, 9 and 12 weight % SPBT, each with ochre color concentrate were melt blended in a single screw extruder, pelletized and dried to less than 1000 ppm moisture prior to fiber spinning. 20 weight % PET was used in the polyamide 6/PET/SPBT blends. The same ochre polyamide 6 color concentrate at the same addition level was used in each polymer matrix. The weight % of each colorant/adjuvant used in each polymer matrix was PY150=0.0459%, YSPR101=0.0277%, PBk6=0.0040%, PBk7=0.0521%, PW6=0.2433%, ZnO=0.0500%, CuHal=0.0300%. The melt blended materials were extruded into undrawn fibers on a slow speed spinning line at a take up speed of 470 m/minute, through 30 hole, (trilobal shaped), spinneret to produce a 30 filament yarn bundle of 1850 denier, referred to as 1850/30Y yarn. The 1850/30Y yarn was then heated over a godet roll set at 170° C. and single stage drawn at a draw ratio of 3.6 to produce approx. 515/30Y denier drawn yarn. The yarns were precision wound onto cards on which spectrophotometric measurements were made. The color strength of each polyamide 6/PET/SPBT blend yarn was compared to the polyamide 6,6 control yarn of the same color as shown in Table 4. In Table 4 it can be seen that for the same colorant content, the color strength increases as the level of SPBT in the fiber increases.

TABLE 4

| Example Number | Polymer Matrix | Weight % SPBT | % Color Strength |
|---|---|---|---|
| 11 | Polyamide 6/PET | 0 | 109 |
| 12 | Polyamide 6/PET/SPBT | 3 | 112 |
| 13 | Polyamide 6/PET/SPBT | 4.5 | 114 |
| 14 | Polyamide 6/PET/SPBT | 6 | 117 |
| 15 | Polyamide 6/PET/SPBT | 9 | 119 |
| 16 | Polyamide 6/PET/SPBT | 12 | 122 |

4 ends of each of the 1850/30Y yarns from the same polymer matrix were draw-textured and co-mingled together to produce 2400 denier, 90 filament, trilobal cross-section, (2400/90Y), BCF yarns. The yarns were drawn over a heated godet roll set at 170° C. single stage drawn at a draw ratio of 3.6 followed by mechanical crimping. The BCF yarns produced were tested for dimensional stability. The results are shown in Table 5.

TABLE 5

| Example Number | Polymer Matrix | Weight % SPBT | Dimensional Stability |
|---|---|---|---|
| 17 | Polyamide 6, 6 | 0 | 29 |
| 18 | Polyamide 6/PET/SPBT | 0 | 16 |

TABLE 5-continued

| Example Number | Polymer Matrix | Weight % SPBT | Dimensional Stability |
|---|---|---|---|
| 19 | Polyamide 6/ PET/SPBT | 3 | 10 |
| 20 | Polyamide 6/ PET/SPBT | 4.5 | 10 |
| 21 | Polyamide 6/ PET/SPBT | 6 | 8 |
| 22 | Polyamide 6/ PET/SPBT | 9 | 8 |
| 23 | Polyamide 6/ PET/SPBT | 12 | 10 |

Examples 24–29

Polyamide 6,6 (control), and polyamide 6,6/PET blends with 20 weight % PET, each with green and sky blue color concentrates were melt blended in a single screw extruder, pelletized and dried to less than 1000 ppm moisture prior to fiber spinning. The same green and sky blue polyamide 6 color concentrate at the same addition level was used in each polymer matrix. The weight % of each colorant adjuvant used in each polymer matrix of the two colors are shown in Table 6.

TABLE 6

| Green Yarns | Sky Blue Yarns |
|---|---|
| PY150 = 0.4287 | PR202 = 0.0316 |
| PB15:1 = 0.0477 | PB15:1 = 0.0344 |
| PG7 = 0.1647 | PBk7 = 0.0133 |
| PBk6 = 0.0354 | PW6 = 0.986 |
| PBk7 = 0.1399 | ZnO = 0.0500 |
| PW6 = 0.0340 | CuHal = 0.0300 |
| ZnO = 0.0500 | |
| CuHal = 0.0300 | |

The melt blended materials were extruded into undrawn fibers on a slow speed spinning line at a take up speed of 470 m/minute, through 30 hole, (trilobal shaped), spinneret to produce a 30 filament yarn bundle of 1850 denier, referred to as 1850/30Y yarn. The 1850/30Y yarn was then heated over a godet roll set at 170° C. and single stage drawn at a draw ratio of 3.6 to produce approx. 515/30Y denier drawn yarn. The yarns were precision wound onto cards on which spectrophotometric measurements were made. The color strength of each polyamide 6,6/PET blend yarn was compared to the polyamide 6,6 control yarn of the same color as shown in Table 7.

TABLE 7

| Example Number | Polymer Matrix | Color | % Color Strength |
|---|---|---|---|
| 24 | Polyamide 6, 6/PET | Green | 123 |
| 25 | Polyamide 6, 6/PET | Sky Blue | 117 |

Four (4) ends of each of the 1850/30Y yarns from the same polymer matrix were draw-textured and co-mingled together to produce 2400 denier, 90 filament, trilobal cross-section, (2400/90Y), BCF yarns. The yarns were drawn over a heated godet roll set at 170° C. single stage drawn at a draw ratio of 3.6 followed by mechanical crimping. The BCF yarns produced were tested for dimensional stability. The results are shown in Table 8.

TABLE 8

| Example Number | Polymer Matrix | Color | Dimensional Stability |
|---|---|---|---|
| 26 | Polyamide 6, 6 | Green | 23 |
| 27 | Polyamide 6, 6/PET | Green | 11 |
| 28 | Polyamide 6, 6 | Sky Blue | 22 |
| 29 | Polyamide 6, 6/PET | Sky Blue | 13 |

Example 30

A polyamide 6/PET/PBT blend with 20 weight % PET and 10% PBT, with ochre color concentrate was spun into an undrawn fiber on a slow speed spinning line at a take up speed of 470 m/minute, through 30 hole, (trilobal shaped), spinneret to produce a 30 filament yarn bundle of 1850 denier, referred to as 1850/30Y yarn. The ochre color concentrate contained the same weight % colorants and aduvants as in Examples 11–23, except SPBT was used as the carrier. The 1850/30Y yarn was then heated over a godet roll set at 170° C. and single stage drawn at a draw ratio of 3.6 to produce approx. 515/30Y denier drawn yarn. The yarns were precision wound onto cards on which spectrophotometric measurements were made. The color strength of the yarn was compared to the polyamide 6,6 control yarn used in the color strength comparisons of Examples 11–16. The color strength was 116%.

Four (4) ends of the 1850/30Y yarn were draw-textured and co-mingled to produce 2400 denier, 90 filament, trilobal cross-section, (2400/90Y), BCF yarns. The yarns were drawn over a heated godet roll set at 170° C. single stage drawn at a draw ratio of 3.6 followed by mechanical crimping. The BCF yarn produced were tested for dimensional stability. The dimensional stability was 8.

While the invention has been described in the foregoing pages in terms of preferred embodiments thereof, it is to be recognized that the description is for illustrative purposes only. Variations and modifications to the specific preferred embodiments disclosed may become apparent to those of ordinary skill in the art, and such variants and modifications may fall within the spirit and scope of the present invention. The scope of the invention thus should be determined by reference to the appended claims.

What is claimed is:

1. A composition for producing colored synthetic fiber having improved color strength and dimensional stability, the composition comprising:

a) at least one fiber-forming polyamide, b) at least one unsulfonated thermoplastic polyester, said thermoplastic polyester being present at between about 15% and about 35% by weight with respect to the total weight of the composition, and forming a dispersed, non-continuous, minor phase in a matrix of said fiber-forming polyamide, c) a colorant system comprising at least one colorant selected from the group consisting of inorganic pigments, organic pigments, and mixtures of inorganic and organic pigments, d) at least one metal sulfonate polyester compatibiliser additive.

2. The composition of claim 1 where in said at least one fiber-forming polyamide is selected from the group consisting of polyamide 6, polyamide 11, polyamide 12, polyamide 6,6, polyamide 6,10, polyamide 6,12, and copolymers, blends and mixtures thereof.

3. The composition of claim 1 wherein said at least one fiber-forming polyamide is selected from the group consisting of polyamide 6 and polyamide 6,6.

4. The composition of claim 1 wherein said at least one thermoplastic polyester is selected from the group consisting of polyalkylene terephthalates, polyalkylene succinates, polyalkylene adipates, polyhydroxyacids, and copolymers, blends or mixtures thereof.

5. The composition of claim 1 wherein said at least thermoplastic polyester is selected from the group consisting of poly(ethylene terephthalate), poly(propylene terephthalate), poly(butylene terephthalate), and copolymers, blends or mixtures thereof.

6. The composition of claim 1 wherein said at least one metal sulfonate polyester compatibiliser additive is selected from the group consisting of alkali metal salts of poly (ethylene terephthalate-co-sulphoisophthalate) and poly (butylenes terephthalate-co-sulphoisophthalate), and blends and mixtures thereof.

7. The composition of claim 6 wherein said metal sulphonate polyester is present between 1 weight % and 25 weight % of the composition.

8. The composition of claim 6 wherein said metal sulphonate polyester is added in an amount such that the composition has between about 300 and about 3500 ppm sulphur.

9. The composition of claim 1 wherein said at least one colorant is selected from the group consisting of metal oxides, mixed metal oxides, metal sulphides, zinc ferrites, sodium alumino sulpho-silicate pigments, carbon blacks, phthalocyanines, quinacridones, nickel azo compounds, mono azo colorants, anthraquinones and perylenes.

10. The composition of claim 1 wherein said at least one colorant is selected from the group consisting of: carbon black, titanium dioxide, zinc sulphide, zinc oxide, Ultramarine Blue, cobalt aluminates, iron oxides, Pigment Blue 15, Pigment Blue 60, Pigment Brown 24, Pigment Red 122, Pigment Red 147, Pigment Red 149, Pigment Red 177, Pigment Red 178, Pigment Red 179, Pigment Red 202, Pigment Red 272, Pigment Violet 19, Pigment Violet 29, Pigment Green 7, Pigment Green 36, Pigment Yellow 119, Pigment Yellow 147 and Pigment Yellow 150.

11. The composition of claim 1 wherein said at least one colorant is present at between about 0.1 weight % and about 8 weight % of the composition.

12. The composition of claim 1, further comprising at least one adjuvant.

13. The composition of claim 12, wherein said at least one adjuvant is selected from the group consisting of antioxidant, stabiliser, processing aid, antimicrobial, flame-retardant, antiozonant, soilproofing agent, stainproofing agent, antistatic additive, lubricant, melt viscosity enhancer, or mixtures thereof.

* * * * *